US007019465B2

(12) United States Patent
Muramatsu et al.

(10) Patent No.: US 7,019,465 B2
(45) Date of Patent: Mar. 28, 2006

(54) DISCHARGE LAMP ILLUMINATION CIRCUIT AND DISCHARGE LAMP ILLUMINATION METHOD

(75) Inventors: Takao Muramatsu, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/914,951

(22) Filed: Aug. 10, 2004

(65) Prior Publication Data

US 2005/0035726 A1 Feb. 17, 2005

(30) Foreign Application Priority Data

Aug. 13, 2003 (JP) ..... P. 2003-292714

(51) Int. Cl.
*H05B 37/02* (2006.01)
*G05F 1/00* (2006.01)

(52) U.S. Cl. ..... 315/226; 315/DIG. 7; 315/291

(58) Field of Classification Search ..... 315/307, 315/291, 209 R, 224–226, DIG. 2, 5, 7
See application file for complete search history.

(56) References Cited

U.S. PATENT DOCUMENTS 5,449,973 A * 9/1995 Yamashita et al. ..... 315/82
5,563,777 A * 10/1996 Miki et al. ..... 363/37
5,666,279 A * 9/1997 Takehara et al. ..... 363/95
5,686,798 A 11/1997 Mattas
6,034,490 A * 3/2000 Yamashita et al. ..... 315/310
6,057,652 A * 5/2000 Chen et al. ..... 315/307
6,340,870 B1 * 1/2002 Yamashita et al. ..... 315/308
6,437,515 B1 * 8/2002 Kamoi et al. ..... 315/209 R
6,459,213 B1 10/2002 Nilssen
6,489,732 B1 * 12/2002 Ito et al. ..... 315/308
6,943,502 B1 * 9/2005 Yamanaka et al. ..... 315/224
2002/0030456 A1 3/2002 Kim
2005/0057181 A1 * 3/2005 Isumi et al. ..... 315/209 R

FOREIGN PATENT DOCUMENTS

JP 7-142182 6/1995
JP 7-169583 7/1995

* cited by examiner

*Primary Examiner*—Wilson Lee
*Assistant Examiner*—Hung Tran Vy
(74) *Attorney, Agent, or Firm*—Fish & Richardson P.C.

(57) ABSTRACT

A discharge lamp illumination circuit 1 has a DC-AC conversion circuit 3 which effects DC-AC conversion and boosting upon receipt of a DC input, and a starter circuit 4. The DC-AC conversion circuit 3 has an AC transformer 7, a plurality of switching elements 5H and 5L, and a resonance capacitor 8. The switching elements are activated by control means 6, thereby inducing series resonance between the resonance capacitor 8 and an inductance component of the AC transformer 7, or between the resonance capacitor 8 and an inductance element connected to the resonance capacitor 8. In connection with the operating frequency of the switching elements, a first frequency value is a frequency value of a period when outputs are open before the discharge lamp 10 is illuminated, and a second frequency value is a frequency value of a period from illumination of the discharge lamp by the starter circuit until elapse of a predetermined time period or a time period which is specified in accordance with an illumination state. The first frequency value is specified to be identical with the first frequency value, or to be close to the first frequency value.

4 Claims, 13 Drawing Sheets

DISCHARGE LAMP ILLUMINATION CIRCUIT AND DISCHARGE LAMP ILLUMINATION METHOD

This application claims foreign priority based on Japanese Patent application No. 2003-292714, filed Aug. 13, 2003, the contents of which is incorporated herein by reference in its entirety.

TECHNICAL FIELD

The present disclosure relates to a discharge lamp illumination circuit and a related method which are adaptable to increasing frequency, and more particularly to a technique for illuminating a discharge lamp reliably and smoothly without requiring complicated control.

BACKGROUND

A known configuration of an illumination circuit of a discharge lamp (e.g., a metal halide lamp) includes a DC power supply circuit having a configuration of a DC-DC converter; a DC-AC conversion circuit (i.e., an inverter circuit); and a starter circuit (i.e., a starter). According to one such a configuration, a DC voltage from a battery is converted to a desired voltage in the DC power supply circuit, and is further converted to an AC output in the subsequent DC-AC conversion circuit. A start-up signal (a so-called starter pulse) is superposed thereon, and the superposed voltage is supplied to the discharge lamp (see, e.g., Japanese Patent Document JP-A-7-142182).

However, a configuration where a voltage is converted through two stages (i.e., a DC-DC voltage conversion and a DC-AC conversion) is not suitable for reducing the size of a circuit of large size. Therefore, there is used a configuration where an output—whose voltage has been boosted by a single-stage voltage conversion in a DC-AC conversion circuit—is supplied to a discharge lamp (see, e.g., Japanese Patent Document JP-A-7-169583)

Subsequently, a no-load output voltage ("OCV") before the discharge lamp is illuminated (i.e., during an extinction period) is controlled so that a start-up signal is generated and supplied to the discharge lamp, there by causing the discharge lamp to illuminate. Thereafter, operation control (i.e., switching control) of the DC-AC conversion circuit is conducted to cause a transition to a steady illumination state.

A conventional illumination circuit may have problems. For example, a conventional illumination circuit may require a complicated control configuration for effecting a smooth and reliable transition of the discharge lamp to a steady illumination state.

SUMMARY

The present disclosure relates to a discharge lamp illumination circuit including a DC-AC conversion circuit which effects DC-AC conversion and boosting upon receipt of a DC input, and a starter circuit for supplying a start-up signal to a discharge lamp. Further, the discharge lamp illumination circuit conducts illumination control of the discharge lamp by controlling a power output from the DC-AC conversion circuit through use of control means. The discharge lamp illumination circuit may be configured as follows.

The DC-AC conversion circuit has an AC transformer, a plurality of switching elements, and a resonance capacitor. The switching elements are activated by the control means, thereby inducing series resonance between the resonance capacitor and an inductance component of the AC transformer, or series resonance between the resonance capacitor and an inductance element connected to the resonance capacitor.

In connection with the operating frequency of the switching elements, a first frequency value—which is a frequency value of a period when outputs are open before the discharge lamp is illuminated—and a second frequency value—which is a frequency value of a period until elapse of a predetermined time period or a time period specified in accordance with an illumination state in the case where the discharge lamp is subsequently illuminated by the starter circuit—are identical, or the second frequency value is close to the first frequency value.

In a discharge lamp illumination method of the present invention, frequencies of an AC voltage and current which are to be supplied to the discharge lamp before the discharge lamp is illuminated is specified as a first frequency value. In the case where the discharge lamp is subsequently illuminated, a second frequency value, which is a frequency value of a period from illumination of the discharge lamp by the starter circuit until elapse of a predetermined time period or a time period specified in accordance with an illumination state, is made identical with the first frequency value or close to the first frequency value.

Therefore, an unintended extinction or the like can be prevented by maintaining a frequency value constant for a certain period of time without switching a switching frequency immediately after illumination of the discharge lamp by means of application of a start-up signal. Further, the reliability of re-illumination can be improved for the case where the discharge lamp is extinguished after temporary illumination. Moreover, complicated control is not required.

In various implementations, one or more of the folling advantages may be present. For example, the present invention may provide a reliable transition-to-steady-illumination control of a discharge lamp by controlling an operating frequency of switching elements without requiring an increase in size of a circuit device or a drastic rise in cost.

In the case where the first and second frequency values are specified as values higher than a series resonance frequency of a period before the discharge lamp is illuminated, a loss of the switching elements can be decreased, thereby increasing circuit efficiency. When an output voltage supplied to the discharge lamp before the discharge lamp is illuminated is arranged to be higher than the output voltage after the discharge lamp is illuminated, reliability of illumination can be improved.

Furthermore, upper and lower limit values of ranges of the first and second frequency values may be specified so that an electrostatic capacitance of the resonance capacitor and a value of an inductance of the AC conversion capacity or of the inductance element are set at appropriate values. Accordingly, electric power can be supplied to maintain illumination of the discharge lamp,and stability of illumination can be improved. The upper limit value is specified at a frequency value which is determined from an intersection of a resonance curve pertaining to an output voltage applied on the discharge lamp during an extinction period before the discharge lamp is illuminated. The lower limit value is specified at a frequency value which is determined from an intersection of a resonance curve pertaining to the output voltage applied on the discharge lamp during an illumination period of the discharge lamp and a minimum voltage with which illumination of the discharge lamp can be maintained.

BRIEF DESCRIPTION OF THE DRAWINGS

FIGS. 7 to 14 show example circuit configurations according to the present invention, wherein FIG. 7 is a block diagram showing an example configuration of control means;

FIG. 8 is a circuit diagram showing an example configuration of a current detection circuit of the discharge lamp;

FIG. 9 is a circuit diagram showing an example configuration of a voltage detection circuit of a discharge lamp;

FIG. 10 is a diagram showing an example configuration of an illumination/extinction discrimination means;

FIG. 11 is a diagram showing an example configuration of a T1 signal generation circuit;

FIG. 12 is a diagram showing an example configuration of an OCV control circuit;

FIG. 13 is a diagram showing an example configuration of a V-F conversion circuit; and FIG. 14 is a diagram showing an example configuration of an OCV control circuit and a T2 signal generation circuit.

DETAILED DESCRIPTION

Figure 1:
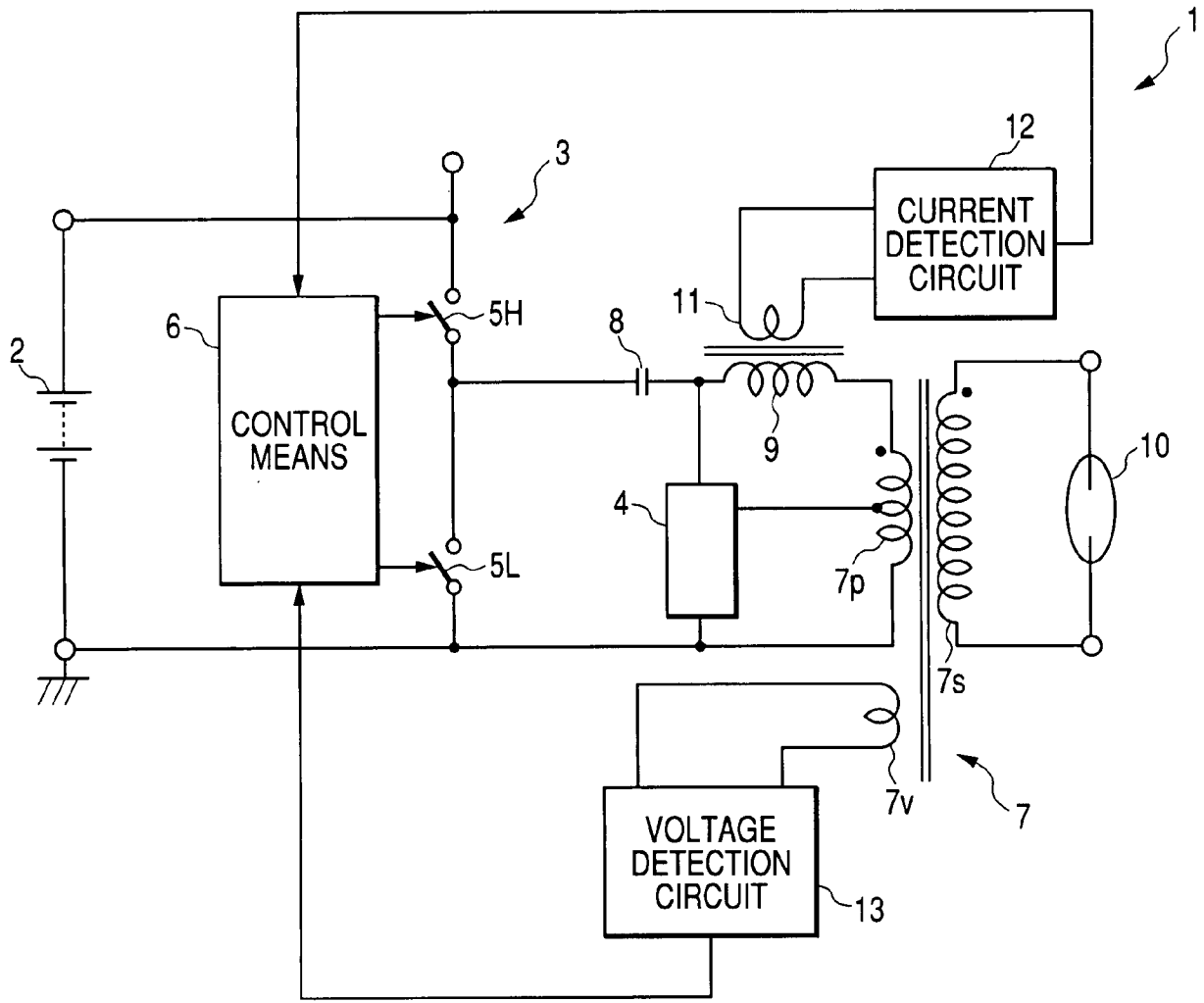
FIG. 1 is a diagram showing an embodiment of the present invention.

FIG. 1 shows an embodiment of the present invention. A discharge lamp illumination circuit 1 includes a DC-AC conversion circuit 3 that receives power from a DC power source 2, and a starter circuit 4.

The DC-AC conversion circuit 3 is provided for effecting DC-AC conversion and boosting upon receipt of a voltage output directly from a battery or the like. The embodiment is provided with two switching elements 5H and 5L, and control means 6 for activating the switching elements 5H and 5L, thereby effecting switching control. More specifically, one end of the switching element 5H on a higher voltage side is connected to a power supply terminal, and the other end of the switching element 5H is grounded via the switching element 5L on a lower voltage side. Further, the two switching elements 5H and 5L are alternately switched on and off by the control means 6. In FIG. 1, the switching elements 5H and 5L are simply denoted by switch symbols. However, the switching elements 5H and 5L may assume the form of a semiconductor switching element such as a field-effect transistor (FET) or a bipolar transistor.

The DC-AC conversion circuit 3 has an AC transformer 7 whose primary circuit and secondary circuit are insulated from each other. Further the embodiment employs a circuit configuration which utilizes a resonance phenomenon between a resonance capacitor 8 and an inductor, or between the resonance capacitor 8 and an inductance component. More specifically, the following three circuit configurations can be enumerated:

(I) a configuration which utilizes resonance between the resonance capacitor 8 and an inductance element;

(II) a configuration which utilizes resonance between the resonance capacitor 8 and a leakage inductance of the AC transformer 7; and (III) a configuration which utilizes resonance between the resonance capacitor 8, the inductance element, and the leakage inductance of the AC transformer 7.

The first configuration (I) may be arranged as follows. An inductance element 9 such as a resonance coil is provided, and one end of the inductance element 9 may be connected to one end of the resonance capacitor 8. The other end of the resonance capacitor 8 is connected to a node between the switching elements 5H and 5L. Further, the other end of the inductance element 9 is connected to a primary winding 7*p* of the AC transformer 7.

The second configuration (II) utilizes an inductance component 9 of the AC transformer 7. Accordingly, a resonance coil or the like does not have to be added. More specifically, the need for an additional resonance coil or the like may be obviated by connecting one end of the resonance capacitor 8 to the node between the switching elements 5H and 5L, and connecting the other end of the resonance capacitor 8 to the primary winding 7*p* of the AC transformer 7.

The third configuration (III) can utilize a synthetic reactance of the inductance element 9 and a leakage inductance, which are arranged in series.

In any of the above configurations, a discharge lamp 10 connected to a secondary winding 7*s* of the AC transformer 7 can be subjected to sinusoidal illumination on condition that the operating frequency of the switching elements is specified to a value of a series resonant frequency or higher by means of utilizing series resonance between the resonance capacitor 8 and an inductive element (i.e., the inductance component or the inductance element), to alternately activate or deactivate the switching elements 5H, 5L. In operation control of the respective switching elements by the control means 6, the switching elements should be activated reciprocally to prevent a state where the two switching elements are activated simultaneously (by way of a non-duty control, which means control of time ratio of on-duty state, or the like). Here, a series resonant frequency is denoted as "f," an electrostatic capacitance of the resonance capacitor 8 is denoted as "Lr," and a primary-side inductance of the transformer 7 is denoted as "Lp1." In the third mode (III), for example, the following relationship holds before the discharge lamp is illuminated:

$$f=f1=1/(2\cdot\pi\cdot\sqrt{Cr\cdot(Lr+Lp1)}).$$

When the operating frequency is lower than f1, a loss of the switching elements is increased. Therefore, switching is activated within a frequency region higher than f1. After the discharge lamp has illuminated, the following relationship holds (note that f1 is lower than f2):

$$f=f2\approx 1/(2\cdot\pi\cdot\sqrt{Cr\cdot Lr}).$$

In this case, switching is activated within a frequency region higher than f2.

The starter circuit 4 is provided for supplying a start-up signal to the discharge lamp 10. An output voltage from the starter circuit 4 at the time of start-up is boosted by the AC transformer 7, and the boosted voltage is supplied to the discharge lamp 10 (in other words, the output voltage—which is converted from DC to AC—is superposed on the start-up signal, and thereafter supplied to the discharge lamp). In the illustrated embodiment, one of the output terminals of the starter circuit 4 is connected to an arbitrary point of the primary winding 7*p* of the AC transformer 7, and the other output terminal is connected to one end (a grounded terminal) of the primary winding 7*p*. However, the circuit configuration is not limited to that arrangement, and there may be employed a configuration where the two output terminals of the starter circuit 4 are connected to arbitrary points of the primary winding 7*p* of the AC transformer 7. To generate a pulse voltage having a peak value sufficiently high for starting the discharge lamp 10 on a secondary side of the AC transformer 7, a capacitor in the starter circuit 4 must be supplied with as high a voltage as possible to effect charging. For instance, a resultant resonant voltage can be utilized when one of input terminals of the starter circuit 4 is connected to a point between the resonance capacitor 8 and the inductance element 9; and the other input terminal is connected to a line of the grounded side. In addition to the foregoing configurations, an input voltage may be supplied to a starter circuit from a secondary side of the AC transformer 7. Alternatively, an auxiliary winding (a winding 11 described later) which constitutes a transformer in combination with the inductance element 9 may be provided so that an input voltage is supplied to a starter circuit from the auxiliary winding.

During an extinction period before the discharge lamp 10 is illuminated, when the switching elements 5H and 5L are activated to apply the OCV to the discharge lamp in a frequency region lower than the resonance frequency f1, a decline in circuit efficiency resulting from an increased switching loss may become a problem. Also, when the switching elements are activated in a frequency region higher than f1, an increase of the switching loss may become a problem. Accordingly, continuous operation of the circuit under no-load conditions is desirably regulated so as not to be prolonged beyond a required period of time.

During an illumination period of the discharge lamp, the circuit is activated continuously, and this requires high circuit efficiency. At this time, when the switching elements are activated in a frequency region lower than f2, the switching loss is increased to lower circuit efficiency. Therefore, the switching elements are preferably activated within a frequency region higher than f2.

During an extinction period (under no-load conditions) of the discharge lamp after the illumination circuit is powered on, the OCV is preferably controlled to a frequency of approximately f1. When the discharge lamp is transitioned to an illumination state after a start-up signal is generated, whereupon the discharge lamp is started up, illumination control is preferably effected within a frequency region higher than f2. However, according to the invention, switching control of the OCV may be conducted so that the operating frequency of the switching elements is specified at a frequency that initially differs from f1, and then gradually approaches f1. More specifically, during the extinction period before the discharge lamp is illuminated, the closer the operating frequency is to the resonant frequency f1, the larger the electric current that is fed to the illumination circuit, because an output voltage of the discharge lamp is increased. In consideration of this, for example, a method for causing the OCV to approach a target value by changing a value of the operating frequency from a higher-frequency side of a resonance curve—whose peak of an output voltage is at f1—is preferable, in view of safety and reliability of the circuit.

Figure 2:
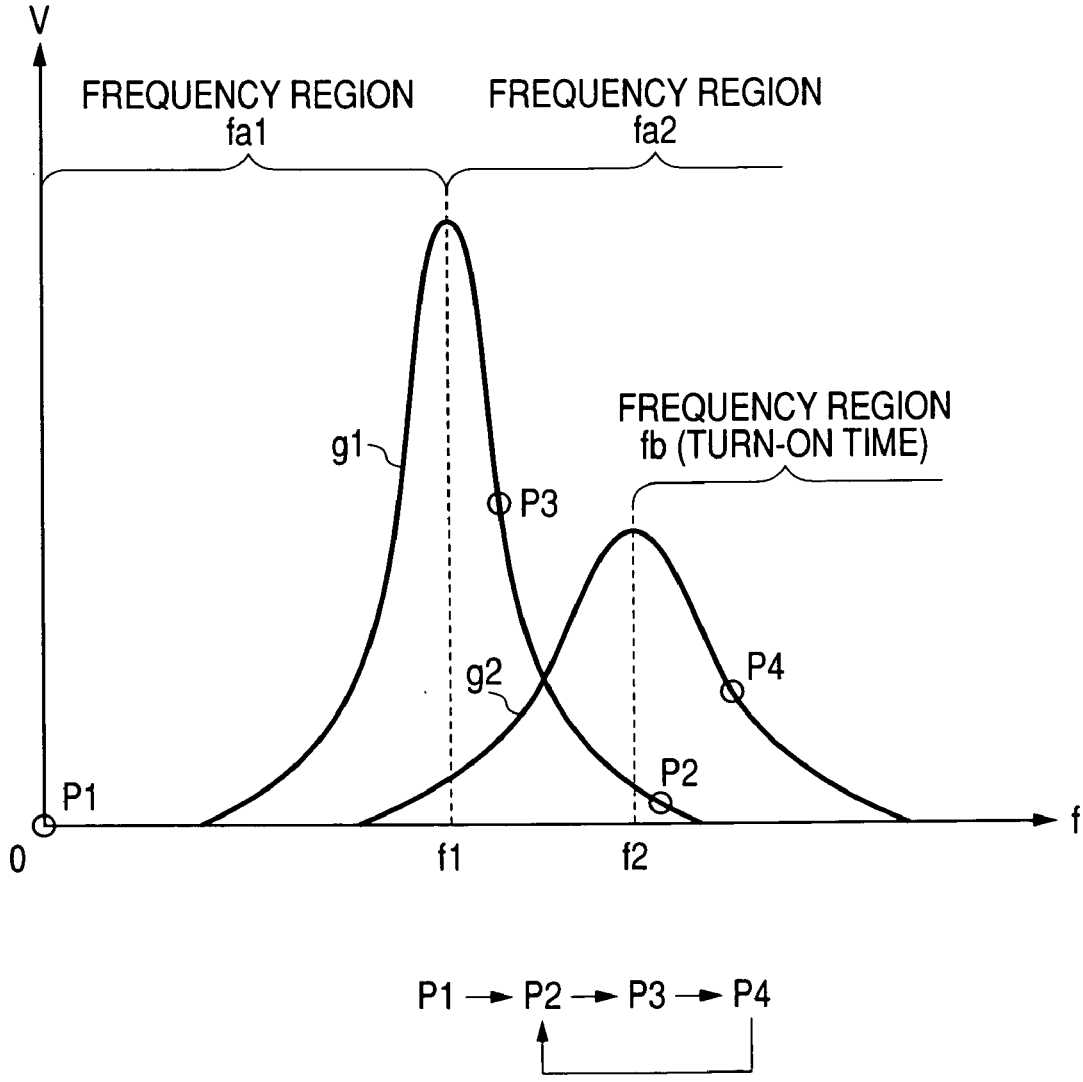
FIG. 2 is a diagram for describing a control mode.

FIG. 2 is a graph for describing a control mode. FIG. 2 shows a resonance curve g1 of an extinction period of the discharge lamp, and a resonance curve g2 of an illumination period. The horizontal axis indicates a frequency "f," and the vertical axis indicates an output voltage V.

The symbols shown in the figure have the following meanings:

"fa1": a frequency region where "f" is lower than f1;

"fa2": a frequency region where "f" is higher than f1;

"fb": a frequency region where "f" is higher than f2 (during an illumination period);

"P1": an operating point before the power is on;

"P2": an initial operating point immediately after the power is on (within the frequency region fb)

"P3": an operating point indicating a time when a target value of the OCV is reached during an extinction period; and "P4": an operating point after the discharge lamp is illuminated (within the frequency region fb).

In the control mode, immediately after the power is turned on or immediately after the discharge lamp is extinguished after temporary illumination, the frequency is forcibly transitioned to the frequency region fb whose frequency is higher than the resonant frequency f2 of the illumination period (p1→p2). More specifically, the frequency is temporarily increased and then decreased gradually so as to approach f1 (P2→P3). When the discharge lamp is illuminated, the frequency is again increased to the frequency region fb (P3→P4).

The transition-to-steady-illumination control of the discharge lamp is conducted in accordance with the following steps: the OCV is controlled; a start-up signal is subsequently generated; and the start-up signal is supplied to illuminate the discharge lamp. As part of control of the OCV, as the frequency is decreased from the region fb so as to approach f1 from the higher-frequency side, the output voltage is gradually increased. Hence, the output voltage attains a target value at the operating point P3 in the frequency region fa2. Subsequently, when the discharge lamp is started by the starter circuit 4, transition to illumination control (power-on control) is effected. The control is performed within the frequency region fb indicated by the operating point P4, regardless of whether or not the discharge lamp is illuminating. Transition from the region fa2 to the region fb may be obtained by causing transition in a stepped manner or by increasing the frequency gradually.

When the discharge lamp is extinguished for any reason other than an extinction instruction, the discharge lamp is caused to return to the transition-to-steady-illumination control (that is, it is returned to P2, then transited P2→P3→P4).

The operation point P2 has a predetermined frequency (a fixed value) within the frequency region fb; however, P4 does not necessarily have a constant frequency (i.e., frequency may vary according to an illumination condition of the discharge lamp).

In the case where the frequency is increased immediately after the power is turned on, the reason why the frequency transitions to the frequency region fb higher than f2 as indicated by the operating point P2 is to allow versatility in the transition-to-steady-illumination control. For instance, when only the control of the OCV is taken into account, a required output voltage can be obtained even when a frequency is specified at a value lower than f1 immediately after the power is turned on. However, if the discharge lamp is extinguished after temporary illumination, so long as the operating point is within the frequency region fb, the OCV value can be increased by decreasing the frequency to cause the frequency to approach f1—which is a resonance frequency during an extinction period—from the higher frequency side. Therefore, a sequence of the transition-to-steady-illumination control for a case immediately after the power is turned on and a sequence of the transition-to-steady-illumination control for a case where the discharge lamp is extinguished after temporary illumination can be set identical without discrimination therebetween. Further, because a circuit section responsible for the control can be used in a shared manner, the configuration can be simplified as compared with that of a circuit where the transition-to-steady-illumination control is conducted upon discrimination between a case immediately after the power is turned on and a case where the discharge lamp is extinguished after temporary illumination.

When the resonance frequencies f1 and f2 assume values higher than an amplitude modulation (AM) band and lower than a short wave or a frequency modulation (FM) band (for example, f1>2 MHz), there is no possibility of yielding a detriment such as a radio noise, because the resonance frequencies f1 and f2 are crossed over substantially instantaneously.

Next, operation of the discharge lamp which is illuminated upon application of a start-up signal to the discharge lamp (i.e., an operation when breakdown is effected) will be described.

Figure 3:
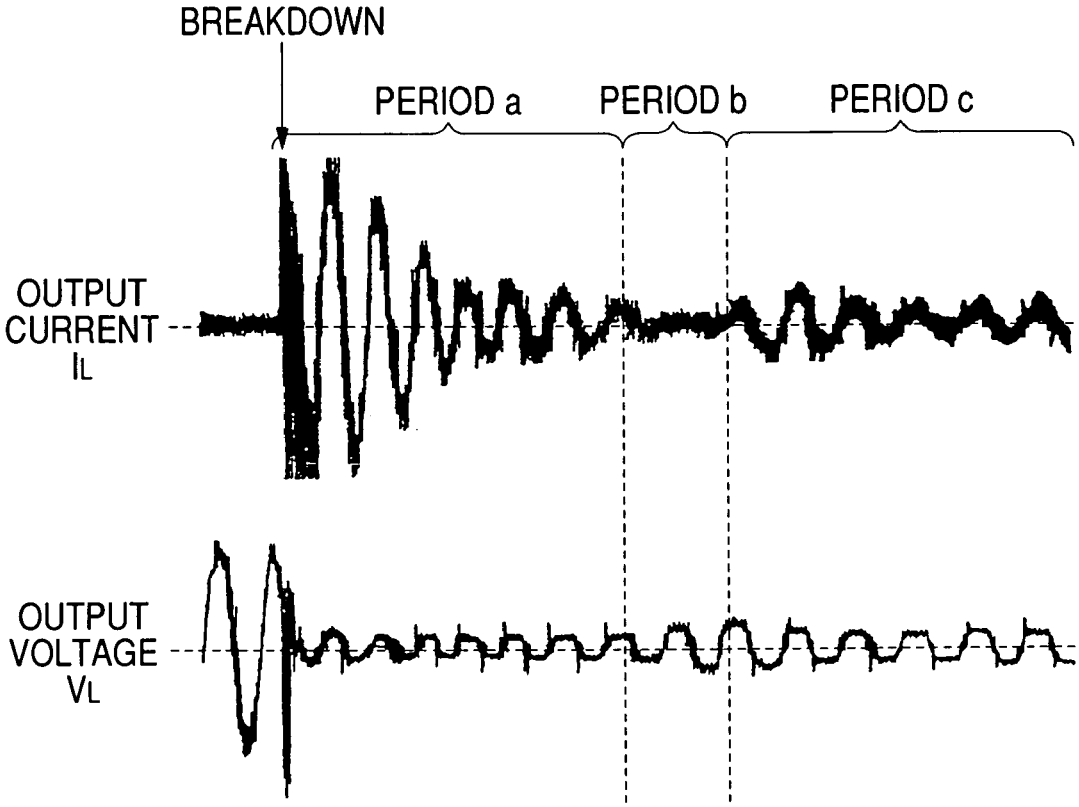
FIG. 3 is a schematic waveform diagram showing states of before and after illumination of a discharge lamp.

In schematic waveforms shown in FIG. 3, the upper waveform shows an output current before and after illumination of the discharge lamp IL, and the lower wave form shows an output current thereof VL.

A period from a time point of a breakdown of the discharge lamp to a transition to a stable-illumination state can be divided, for example, into the following three periods:

a period "a": a period from immediately after breakdown of the discharge lamp until emission of energy accumulated in the starter circuit;

a period "b": a period during which the output current IL is zero or approximately zero; and a period "c"; a period when illumination of the discharge lamp is maintained after re-illumination.

During the period "a," as shown in the waveform of the output current IL, a vibration is induced at a series resonant frequency (f1) between a resonance capacitor (Cr) and an inductance element (Lr).

Subsequently, during the period "b," emission of all energy accumulated in a capacitor in the starter circuit 4 is completed, whereby the current IL becomes zero. In some cases the period "b" is not included, and a transition is effected from the period "a" to the period "c."

The phrase "the current IL is zero or approximately zero" means that both terminals across the discharge lamp are opened. In other words, the phrase means that a secondary side of the AC transformer 7 is brought into an open state. Accordingly, when the time period during which the frequency remains in the vicinity of f1 is long, an increase of loss becomes a problem. Therefore, the frequency is preferably transitioned to a frequency region higher than f2 as early as possible. However, when the frequency is increased in the middle of the period "a" or "b" because of a large deviation from f1 of before illumination, there is an increased possibility that illumination of the discharge lamp cannot be maintained or that transition back to the illumination state is disabled.

Accordingly, assuming that "F1" denotes a first frequency during an opened period before the discharge lamp is illuminated and "F2" denotes a second frequency value, which is a frequency value of a period from illumination of the discharge lamp by the starter circuit until elapse of a predetermined time period or a time period specified in accordance with an illumination state, F1 and F2 are specified so that F1 and F2 are identical or close to each other. In other words, by maintaining the operating frequency of the switching elements constant or approximately constant before and after illumination, series resonance between the above-mentioned Cr and (Lr+Lp1) is started even immediately after the current IL becomes zero, thereby increasing an output current which is supplied to the discharge lamp. In this case, an important point is that the operating frequency is close to f1. When the output voltage is not increased at the time when IL becomes zero, the illumination lamp easily falls into an extinction state. The following modes can be applied for maintaining the frequency in the case where the discharge lamp is illuminated: a mode where a predetermined time period is specified; and a mode where a time length—which is used for specifying a time period in accordance with an illumination state of the discharge lamp—is set. In both cases, a lower limit is a time length including the periods "a" and "b," and an upper limit is a maximum allowable time length which the switching elements can endure.

Figure 4:
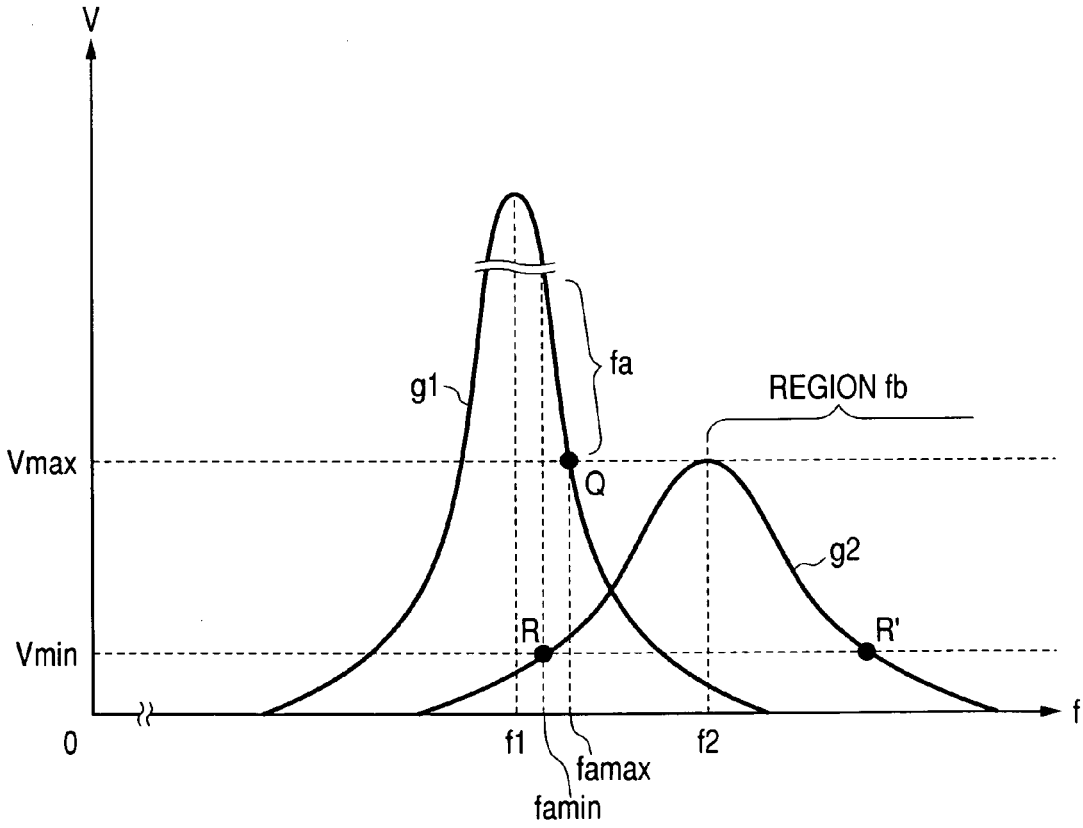
FIG. 4 is a diagram for describing a control range of an operating frequency.

FIG. 4 shows a resonance curve g1 of an extinction period of the discharge lamp, and a resonance curve g2 of an illumination period. The horizontal axis indicates a frequency "f," and the vertical axis indicates an output voltage V. F1 and F2 are, in view of reducing a loss of the switching elements, preferably specified at a series resonance frequency or higher pertaining to a period before the discharge lamp is illuminated. The series resonance frequency is determined by an electrostatic capacitance of the resonance capacitor; and a winding inductance and a leakage inductance of the AC transformer 7, or an inductance of the inductance element).

The symbols shown in the figure have the following meanings:

"Vmax": a maximum voltage during an illumination period;

"Vmin": a minimum bulb voltage with which illumination can be maintained;

"famax": a frequency at an intersection Q of the resonance curve g1 and a line "V=Vmax";

"famin": a frequency at a lower-frequency intersection R of the resonance curve g2 and a line "V=Vmin";

"fa": a range within which F1 and F2 are controlled ("If" falls within the range of famin to famax); and "fb": a frequency control region used during an illumination period ("f" is higher than f2).

As shown in fa in FIG. 4, the closer the value of F1 or F2 is set to f1, the steeper a resonance voltage rises at a time when resonance is started again, hence rendering smoother re-illumination of the discharge lamp after extinction (hereinafter, referred to as "re-illumination"). In other words, in the case where the resonance voltage rises slowly, the discharge lamp is difficult to re-illuminate. Meanwhile, the term "re-illumination" referred to here does not include a case where the re-illumination is caused by an operation of a user (for example, a case where an illumination switch is turned on again after being turned off). That is, the term "re-illumination" means a phenomemalistic event such that even when a current flows after breakdown of the discharge lamp upon application of a start-up signal and then IL temporarily falls to zero during the period "b," the current starts to flow again during the period "c."

When fa is made too close to f1, the output voltage is increased, which becomes a problem in view of a withstand voltage or a load of a circuit element. Therefore, a circuit should be designed with attention focused on avoiding an increase in size or a rise in cost of the circuit resulting from employing parts of high withstand voltage.

As is clear from a peak value of the resonance curve g2 being Vmax or lower, when the output voltages to the discharge lamp during periods before and after illumination of the discharge lamp are compared, the voltage within a control range fa before illumination is higher than that during illumination. Accordingly, reliability of illumination or re-illumination can be improved.

During the period "c," illumination of the discharge lamp is maintained after being re-illuminated. However, when sufficient electric power for maintaining the discharge lamp illuminated cannot be supplied to the discharge lamp within the control range fa, the discharge lamp is more likely to be extinguished.

Therefore, in the case where the switching elements are activated within a control range fa in which the discharge lamp is illuminating, in order to guarantee that the illumination of the discharge lamp is maintained, the following condition ahould be satisfied.

The electrostatic capacitance of the resonance capacitor, and the inductance of the AC transformer or the inductance element are set so that F1 and F2 fall within the range of famin to famax.

From a relationship that "an output voltage within the control range fa is higher than that within the frequency range fb," an upper limit value of fa is determined from an intersection between the resonance curve g1 and Vmax, which is the maximum voltage of the illumination period. A lower limit value of fa is determined from an intersection between the resonance curve g2 and Vmin, which is the minimum voltage with which illumination of the discharge lamp can be maintained.

There are two intersections between the resonance curve g2 and the line "V=Vmin" (i.e., the lower-frequency intersection R and an upper-frequency intersection R'). However, the one which satisfies a requirement of being smaller than fmax (famin is lower than famax); that is, the intersection R gives a lower limit of fa. Therefore, attention should be paid so that excessive separation between f1 and f2 will not produce a range of fa which satisfies the above requirement.

The foregoing requirement may be satisfied by setting values of f1 and f2 appropriately, for example, by setting circuit constants (the above-mentioned Cr, Lr, or Lp1) which determine f1 and f2.

In the case where switching is controlled with an operating frequency within the control range fa, an increased load is applied on the switching elements. Therefore, the frequency preferably does not remain within fa beyond a required period. Accordingly, a temporal restriction associated with the transition-to-steady-illumination control of the discharge lamp will be described below.

To restrict a time interval during which the frequency remains in the vicinity of the resonance frequency f1 during an extinction period, a transition may be effected to the frequency region fb after a predetermined time period has elapsed from a time point where the discharge lamp is detected as having been extinguished or a time point when the value of the OCV has attained a target value. The reason why an illumination (i.e., breakdown) point is not set at a temporal starting point is that the frequency may remain in the vicinity of f1 for a long time in the case where the discharge lamp fails to illuminate. In addition, other advantages can also be obtained, such that determining whether or not the lamp is illuminating does not have to be conducted quickly.

The invention can be implemented, for example, in the following configuration patterns:

(i) a configuration pattern 1 where the operating frequency of the switching elements is caused to transition temporarily to the frequency region fb after a predetermined time period has elapsed since a start of the OCV control; and (ii) a configuration pattern 2 where the operating frequency of the switching elements is caused to transition temporarily to the frequency region fb after elapse of a time period—where the operating frequency is fixed to a predetermined value—from a time point where the OCV is boosted to a predetermined voltage.

A case where F1 is assumed to be identical with F2 will be described below

Figure 5:
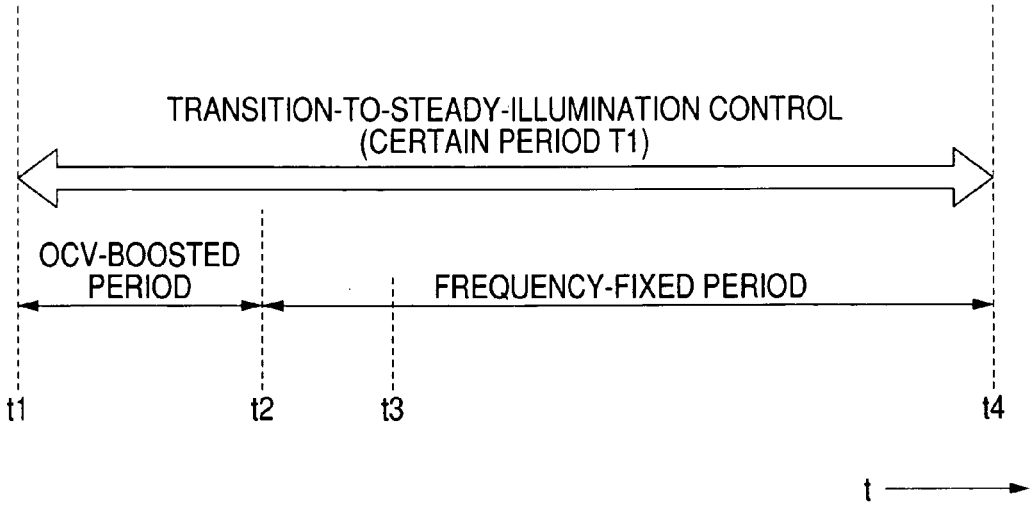
FIG. 5 is an explanatory diagram for a temporal restriction associated with transition-to-steady-illumination control.

FIG. 5 is a descriptive view of the configuration pattern 1, and the arrow "t" indicates a direction of time passage.

A period T1 indicates a period (predetermined period) of the transition-to-steady-illumination control, and a starting point t1 of T1 is assumed to be a time when the discharge lamp is determined as having been extinguished. The transition-to-steady-illumination control is started upon that determination. The time period T1 includes the time required for boosting the OCV to attain a target voltage, and a time period after the OCV has reached the target value for conducting switching control while the operating frequency is fixed at F1 (=F2) (hereinafter referred to as "frequency-fixed period"). In FIG. 5, t2 indicates a time at which the OCV has attained the target value; t3 indicates a time at which the discharge lamp is caused to illuminate (i.e., break down); and t4 indicates a time when the time period T1 has elapsed.

After a first time period (a boost period) required for boosting the OCV and a subsequent second time period (the frequency-fixed period), the operating frequency of the switching elements is specified to a frequency higher than f2, while a time period T1, which includes the first and second time periods, is set to be constant. After the time period T1 has elapsed, the frequency is transitioned to the frequency region fb without fail, regardless of whether or not the discharge lamp is illuminating. Hence, the time period during which the frequency remains in the vicinity of f1 can be regulated. The duration of the period T1 is determined in view of the relationship that the longer the time period T1, the more reliably the discharge lamp can be illuminated. However, the longer the time period T1, the greater a loss or a probability of failure. In view of these factors, the period T1 should be specified to satisfy both requirements.

In the illumination method of the configuration pattern 1, F1 (pertaining to a period before the discharge lamp is illuminated) is not increased immediately after the discharge lamp is illuminated. Instead, F2 (pertaining to a period until elapse of a time, which is specified in accordance with an illumination state) is arranged to be identical with F1 (or is arranged to be close to F1).

Figure 6:
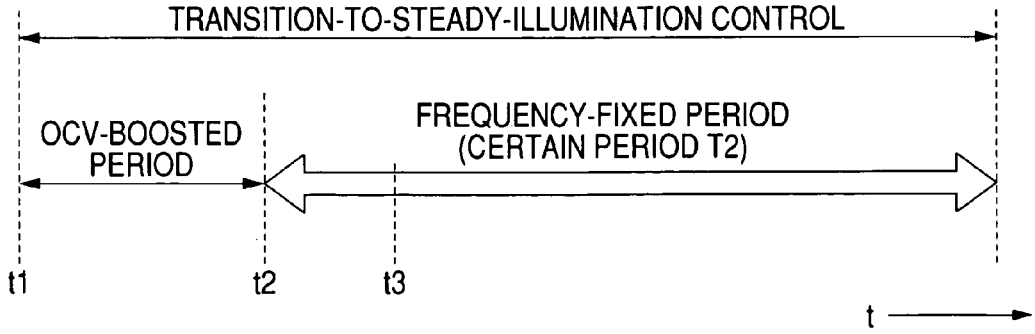
FIG. 6 is another explanatory diagram for a temporal restriction associated with transition-to-steady-illumination control.

FIG. 6 is a descriptive view of the configuration pattern 2, which differs from the configuration pattern 1 in that the frequency-fixed period indicated by T2 is regulated to a predetermined time period.

In the configuration pattern 2, the OCV is increased upon extinction of the discharge lamp. After the OCV has attained the target value, the operating frequency of the switching elements is fixed at a predetermined value greater than the predetermined time period T2. Within the frequency-fixed period T2, a start-up signal is generated, and the start-up signal is applied to the discharge lamp.

In the illumination method of the configuration pattern 2, in connection with F1 (pertaining to a period before the discharge lamp is illuminated) F2 (pertaining to a period from the OCV has attained a predetermined value until elapse of a predetermined time period) is arranged to be identical with F1 (or is arranged to be close to F1). That is, the duration of the period T2—where the operating frequency is fixed to a predetermined value F1 (=F2)—is set constant. After the time period T2 has elapsed, the frequency is transitioned to the frequency region fb, regardless of whether or not the discharge lamp is illuminating. Hence, the time period during which the frequency remains in the vicinity of f1 can be regulated. The duration of the first time period required for boosting the OCV is not constant. However, in the configuration pattern 2, a time length of the period T2 can be specified at a desired value.

The duration of the above-mentioned frequency-fixed period ranges from the periods "a" and "b" in FIG. 3 to an upper limit duration where a withstand voltage of the switching elements is taken into account.

FIGS. 7 to 14 show specific examples of circuit configurations according to the invention.

The configuration pattern 1 will be described first, by reference to FIGS. 7 to 13.

Figure 7:
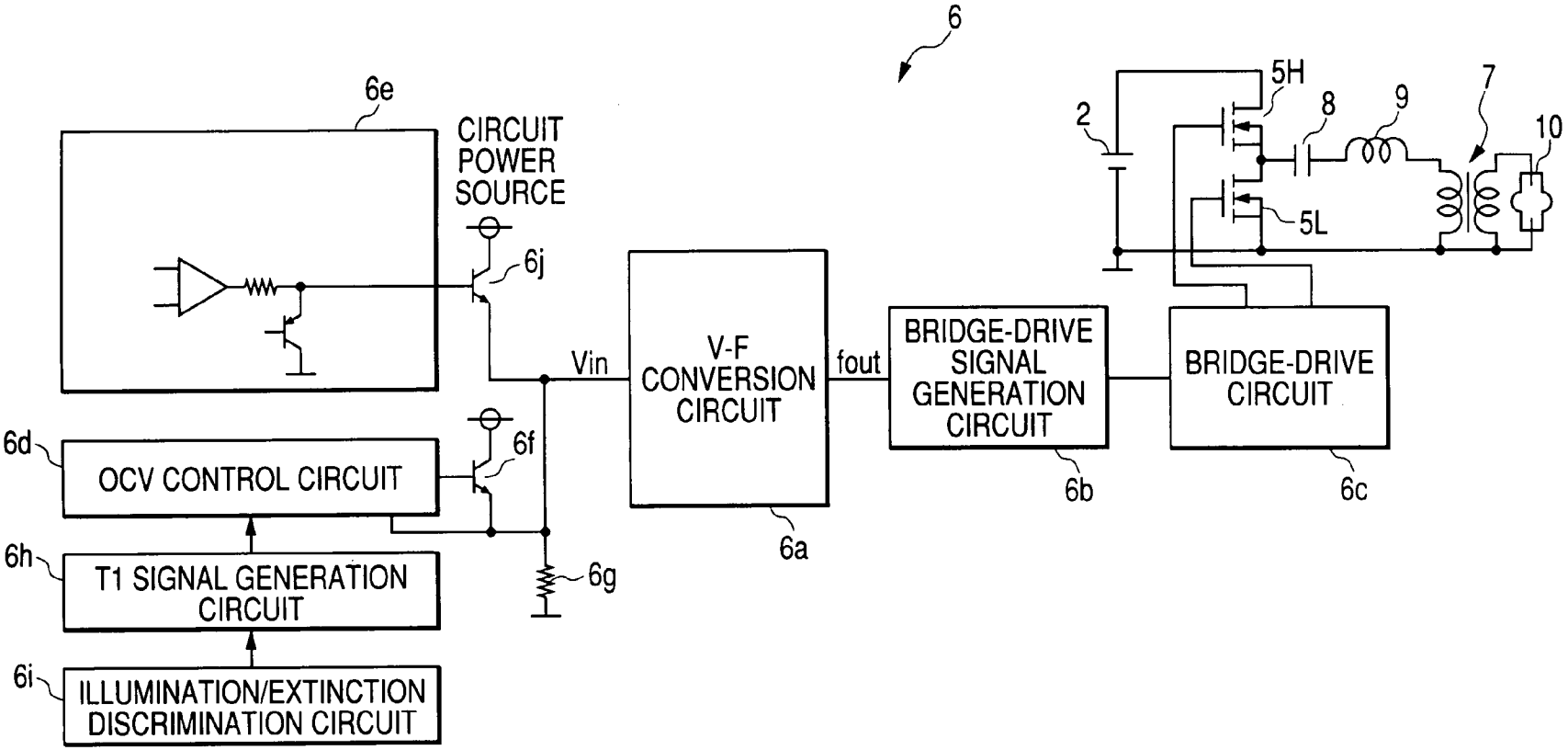

FIG. 7 shows an example circuit configuration of the control means 6. More specifically, FIG. 7 shows an example configuration in which a voltage-frequency conversion circuit (a "V-F conversion circuit") for changing a frequency depending on an input voltage is used. In FIG. 7, Vin indicates an input voltage of a V-F conversion circuit 6*a*, and fout indicates a frequency of an output voltage which is converted by the V-F conversion circuit 6*a*.

The V-F conversion circuit 6*a* has a control characteristic such that fout is increased with an increase in Vin. The output voltage is transmitted to a subsequent bridge-drive-signal generation circuit 6*b*. Further, the output signal from the bridge-drive-signal generation circuit 6*b* is transmitted to respective control terminals of the switching elements 5H and 5L via a bridge drive circuit 6*c*. For instance, in a frequency region higher than the resonance frequency, the larger the value of Vin, the smaller the value of fout. As a result, when Vin is increased, the output power (or the output voltage) is increased. In contrast, the smaller the value of Vin, the larger the value of fout. Accordingly, when the Vin value is decreased, the output power (or the output voltage) is suppressed and thereby decreased.

As described above, Vin is a voltage for controlling the frequency of the switching elements. In the example circuit configuration, Vin is specified by outputs from an OCV control circuit 6*d* and an on-operation-power-control circuit 6*e*.

The OCV control circuit 6*d* is a circuit for controlling a no-load output voltage before illumination of the discharge lamp. An emitter output from an NPN transistor 6*f* which is provided on an output stage of the OCV control circuit 6*d* is supplied to a resistor 6*g*, and thereafter supplied to an input terminal of Vin.

A T1 signal generation circuit 6*h* is a circuit for generating a pulse signal having a width corresponding to the above-mentioned transition-to-steady-illumination period T1 in response to a signal from an illumination/extinction discrimination circuit 6*i*. The generated signal is transmitted to the OCV control circuit 6*d*.

The on-operation-power-control circuit 6*e* is a circuit for controlling a transitional power input of the discharge lamp and a power input at a steady illumination state after the discharge lamp is illuminated. An emitter output from an NPN transistor 6*j*, which is provided on an output stage of the on-operation-power-control circuit 6*e*, is sent to the V-F conversion circuit 6*a*. An arbitrary circuit configuration may be adopted for the on-operation-power-control circuit 6*e*. Hence, a known configuration can be used. For example, there can be provided an error amplifier which performs calculations from a voltage detection signal or a current detection signal of the discharge lamp, or a limiting circuit (for a lower limit) for limiting a controlled output to prevent the operating frequency from becoming lower than f2 during an illumination period of the discharge lamp.

The output having the higher voltage as between the OCV control circuit 6*d* and the on-operation-power-control circuit 6*e* is selected and supplied to the V-F conversion circuit 6*a* as a control voltage. Further, an output signal which is obtained through conversion of the control voltage, is transmitted to the switching elements 5H and 5L as a control signal via the bridge-drive-signal generation circuit 6*b* and the bridge-drive circuit 6*c*.

FIG. 1 shows a circuit configuration having no DC-DC converter. In this circuit configuration, power of the discharge lamp is controlled, by means of converting a DC input to AC and boosting the resultant voltage through use of only the DC-AC conversion circuit 3. If a path for detecting current flowing in the discharge lamp cannot be secured, it is better to detect a current value and a voltage value of the illumination lamp, by adding a winding to the resonance inductance element 9 and another winding to the AC transformer 7.

For instance, as shown in FIG. 1, the auxiliary winding 11 forming a transformer in combination with the inductance element 9 is provided for detection of a current corresponding to a current flowing in the discharge lamp 10. An output from the auxiliary winding 11 is supplied to a current detection circuit 12. In other words, a current flowing in the discharge lamp 10 is detected by means of the inductance element 9 and the auxiliary winding 11. The detection result is sent to the control means 6, and utilized for power control or discrimination of illumination/extinction of the discharge lamp 10.

A voltage applied on the discharge lamp 10 is detected from an output from the primary winding 7*p* or the secondary winding 7*s* of the AC transformer 7, or from a detection winding 7*v* which is provided on the AC transformer 7. In the example circuit configuration, an output from the detection winding 7*v* is supplied to a voltage detection circuit 13, whereby a detection voltage corresponding to a voltage applied on the discharge lamp 10 through the voltage detection circuit 13 is obtained. Subsequently, the detection voltage is sent to the control means 6, and utilized for power control or discrimination of illumination/extinction of the discharge lamp.

Figure 8:
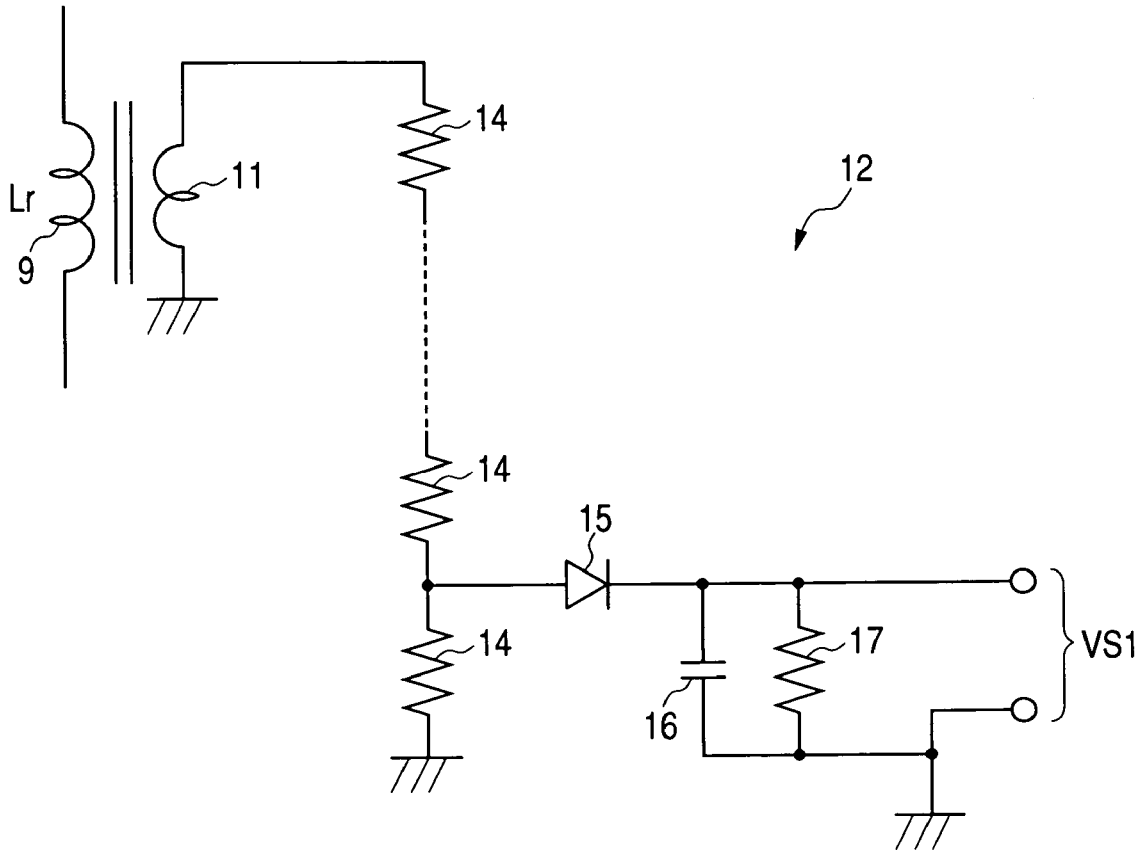

FIG. 8 shows an example circuit configuration of the current detection circuit 12.

A plurality of voltage dividing resistors 14, 14, . . . are connected in series to one end (i.e., a terminal on a not-grounded side) of the auxiliary winding 11. One end of a voltage-dividing resistor 14, which is disposed at a lowermost stage, is connected to a diode 15, and the other end is grounded. The divided-by-resistor voltage is supplied to an anode of the diode 15, and a cathode of the diode 15 is connected to one of detection output terminals.

One end of a capacitor 16 is connected to the cathode of the diode 15, and the other end is grounded. A resistor 17 is connected in parallel with the capacitor 16.

As described above, a detector circuit of basic configuration can be used as the current detection circuit 12. Accordingly, a DC signal detected by the inductance element 9 and the auxiliary winding 11 is converted into an AC signal (see the detection voltage VS1 in FIG. 8).

By being subjected to voltage division using a plurality of resistor elements, a start-up signal generated by the starter circuit 4 can be suppressed to a level where a detection voltage corresponding to a peak voltage of the start-up signal is negligible. Therefore, a circuit configuration for suppressing a high voltage generated upon start-up of the discharge lamp is very simple.

In addition, a current detection signal obtained through the current detection circuit 12 may be used for the OCV control circuit 6*d* to be described later.

Figure 9:
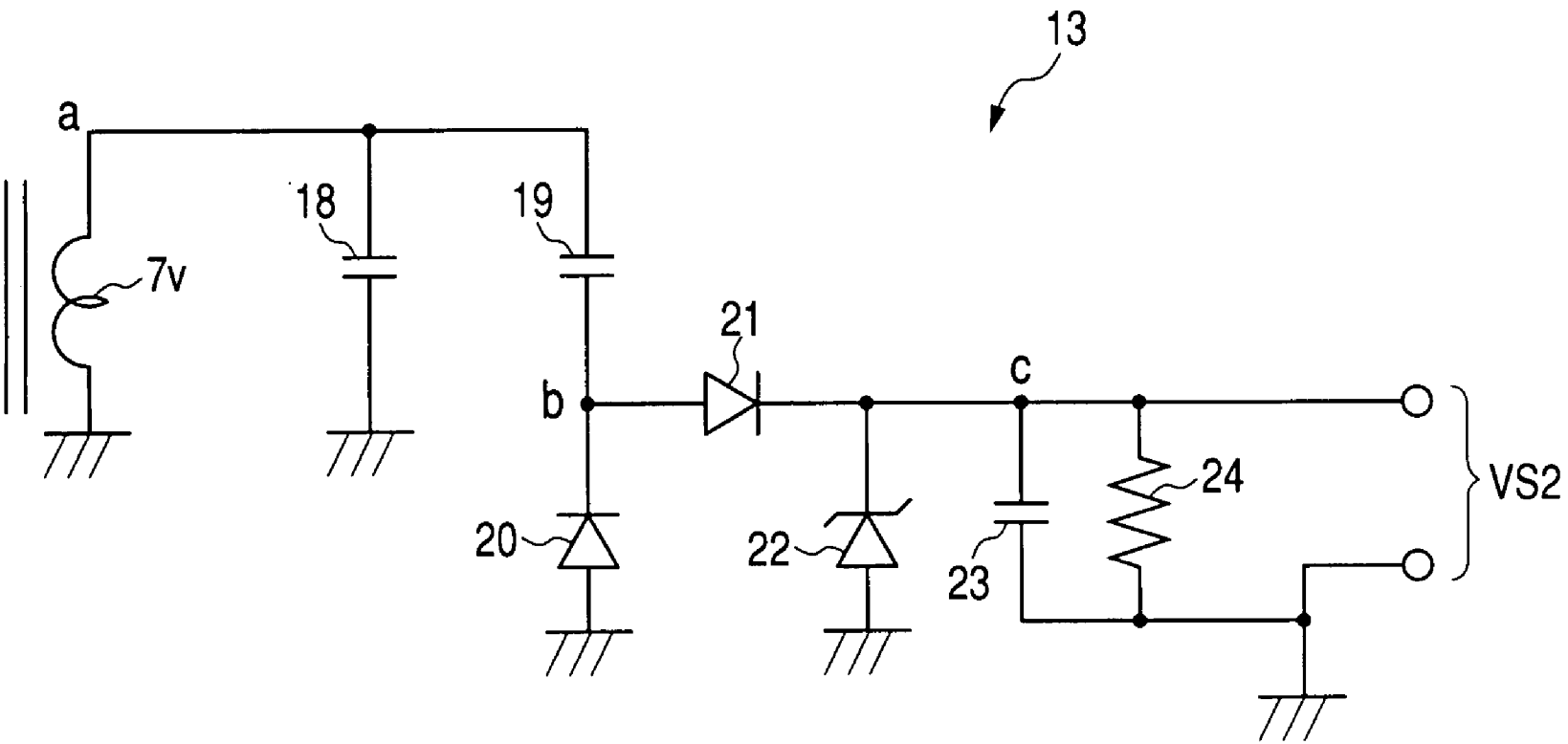

FIG. 9 shows an example circuit configuration of the voltage detection circuit 13.

A terminal on a non-grounded side of the detection winding 7*v* (see point "a" in FIG. 9) is connected to one end of a capacitor 18, and the other end of the capacitor 18 is grounded. Further, a capacitor 19 which is provided in parallel with the capacitor 18 is connected to a cathode of a diode 20 and an anode of a diode 21. The anode of the diode 20 is grounded.

A cathode of the diode 21 is connected to one of detection output terminals, and also is connected to a cathode of a Zener diode 22 and one end of a capacitor 23. An anode of the Zener diode 22 and the other end of the capacitor 23 are grounded.

A resistor 24 is connected in parallel with the capacitor 23 to obtain a detection voltage indicated by VS2.

In the circuit, upon start-up of the discharge lamp, a voltage is applied on the detection winding 7*v* in a condition in which a high-voltage pulse is applied thereon. However, the voltage can be detected by use of the capacitors 19 and 23, and the resistor 24. When magnitudes of impedances of the capacitors 19 and 23 are compared, the impedance of the capacitor 23 is approximately one order of magnitude smaller than that of the capacitor 19. In addition, a resistance value of the resistor 24 is set sufficiently large as compared with an impedance of the capacitor 23. Therefore, a voltage applied to the point "b" (a node between the anode of the diode 21 and the capacitor 19) in FIG. 9 is determined from an impedance ratio between the capacitors 19 and 23.

After the discharge lamp is illuminated, an electric current is caused to flow only in one direction by action of the diode 21. Accordingly, the capacitor 23 is charged gradually, thereby increasing voltages across the capacitor 23 (see the point "c" in FIG. 9). When a potential at one end of the detection winding 7*v* (a potential at the point "a" in FIG. 9) and a terminal potential (a potential at the point "c" in FIG. 9) of the capacitor 23 become nearly equal, a current is caused not to flow into the capacitor 19. That is, a detection voltage under a steady illumination condition of the discharge lamp can be detected without voltage division by the capacitors 19 and 23 even when a voltage applied on the detection winding 7*v* is small. Hence, the required accuracy can be guaranteed.

Meanwhile, the capacitor 18 at a first stage is provided for absorbing a re-striking voltage. The Zener diode 22 performs a function as a clamping element for suppressing a high voltage entailed by generation of a start-up pulse voltage, and serves as a limiting circuit for a surge voltage entailed by the generation of the start-up pulse voltage.

Figure 10:
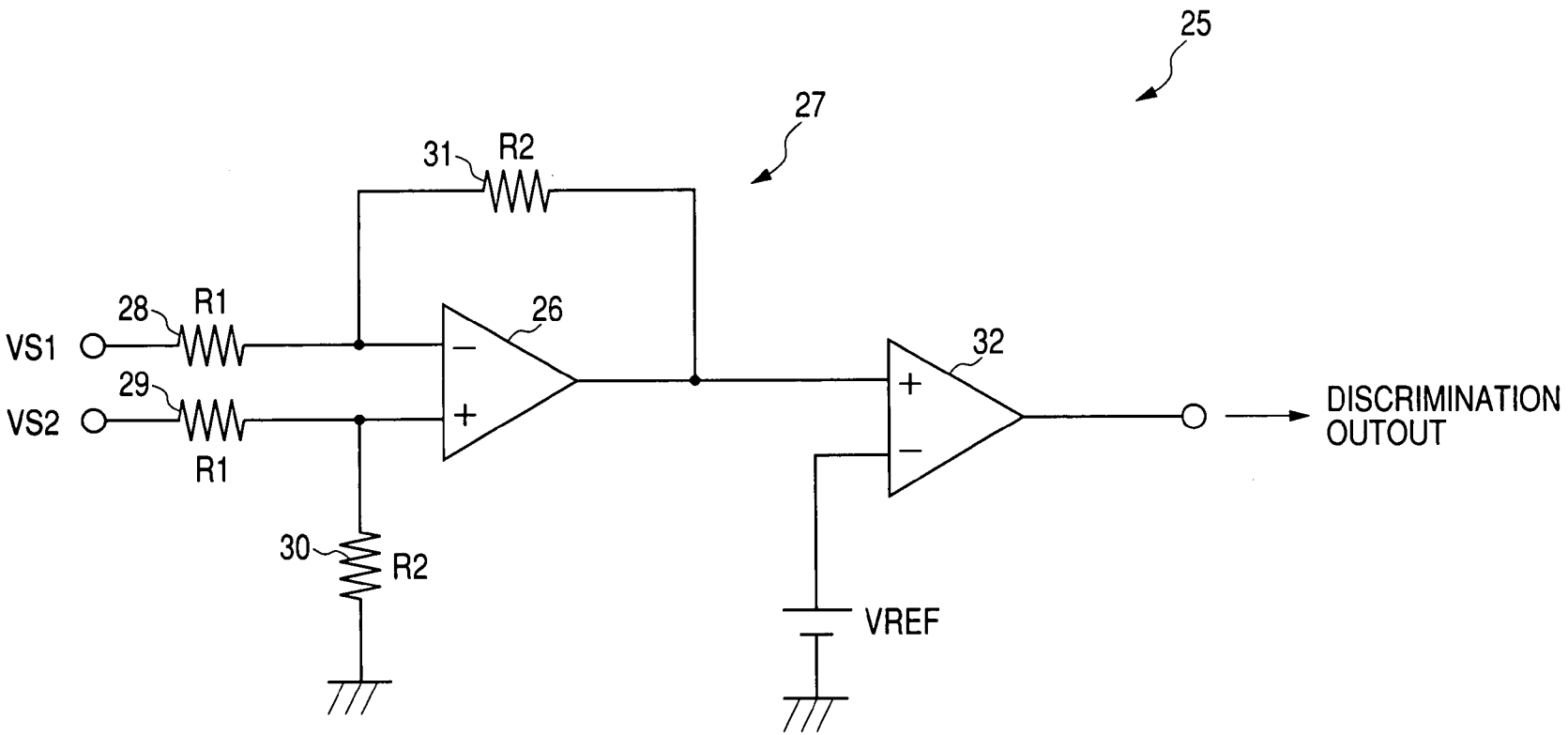

FIG. 10 is a circuit diagram showing an example configuration 25 of the illumination/extinction discrimination circuit 6*i*.

The detection voltage VS1 obtained from the current detection circuit 12 and the detection voltage VS2 obtained from the voltage detection circuit 13 are supplied to a subtraction circuit 27 which uses an operational amplifier 26. More specifically, VS1 is supplied to an inverting input terminal of the operational amplifier 26 via a resistor 28, and VS2 is supplied to a non-inverting input terminal of the operational amplifier 26 via resistors 29 and 30. Further, one end of the resistor 30 is connected to the non-inverting input terminal of the operational amplifier 26, and the other end of the resistor 30 is grounded. A resistor 31 is provided between the inverting input terminal of the operational amplifier 26 and an output terminal of the operational amplifier 26. Furthermore, resistance values of the resistors denoted as "R1") are set to be identical with each other, and resistance values of the resistors 30 and 31 (denoted as "R2") are set to be identical with each other.

The operational amplifier 26 sends an output ((R2/R1)·(VS2−VS1))—which is proportional to a difference between VS2 and VS1—to a non-inverting input terminal of a comparator 32 provided at a subsequent stage. A predetermined reference voltage (denoted as "VREF") is supplied to an inverting input terminal of the comparator 32. Whether or not the discharge lamp is illuminating is determined by comparing a calculation result—which is proportional to (VS2−VS1)—with VREF. More specifically, in the case where a level of the output from the operational amplifier 26 is VREF or higher, an output signal from the comparator 32 reaches a high (H) level, which indicates that the discharge lamp is extinguished. In contrast, in the case where the level of the output from the operational amplifier 26 is lower than VREF, the output signal from the comparator 32 falls to a low (L) level, which indicates that the discharge lamp is illuminating.

The example configuration 25 is provided with a circuit for subtracting a current detection value from a voltage detection value of the discharge lamp; and a circuit for comparing the subtraction result with a threshold voltage value. Hence, an illumination/extinction discrimination signal (denoted as "Si") of the discharge lamp is obtained as a binary signal.

Figure 11:
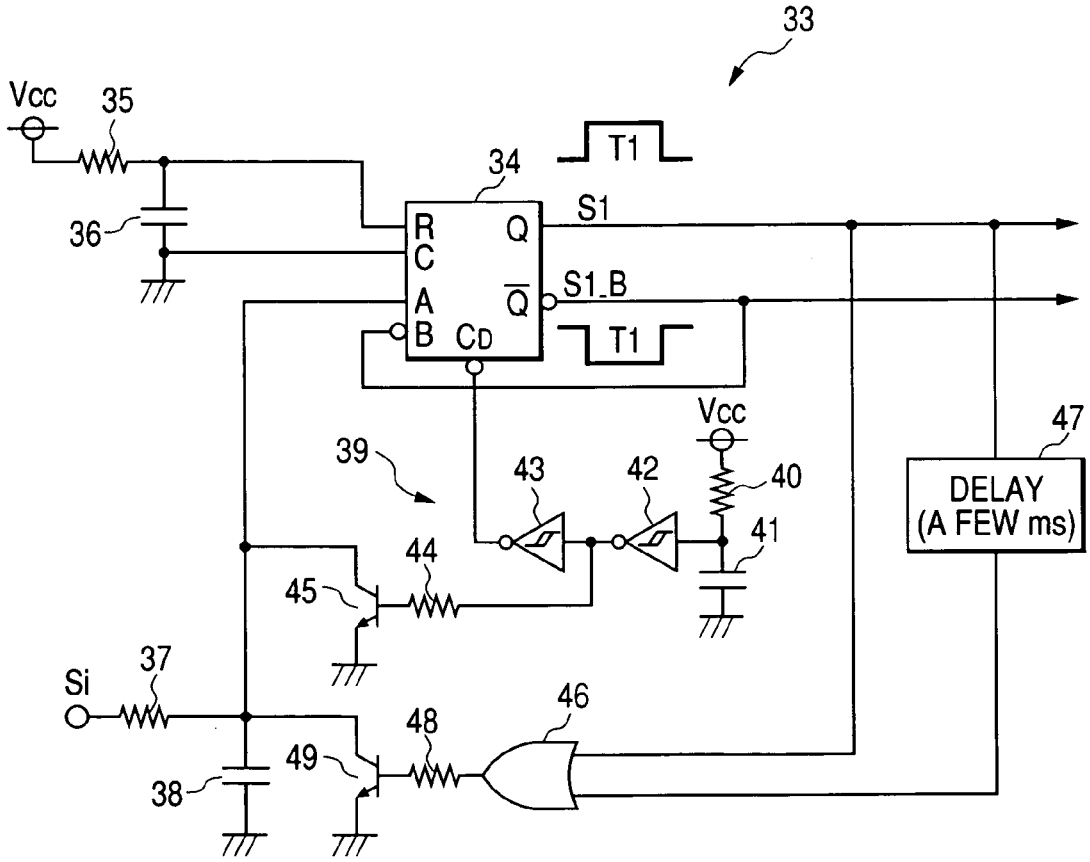

FIG. 11 is a circuit diagram showing an example circuit configuration 33 of the T1 signal generation circuit 6*h*.

The present embodiment employs a monostable multivibrator IC 34, which generates a pulse signal S1 that indicates the predetermined period T1 and a pulse signal S1_B which is an inversion signal of S1. Further, the signals S1 and S1_B are supplied to the OCV control circuit 6*d* (described below). More specifically, when the illumination/extinction discrimination signal Si reaches an H level during the extinction period of the discharge lamp, the H level signal is input to the monostable multivibrator 34 via an RC filter (a resistor 37 and a capacitor 38). Thereafter, the signals S1 and S1_B having a width corresponding to the transition-to-steady-illumination period T1 are output.

A predetermined power supply voltage Vcc is supplied to a terminal R of the monostable multivibrator 34 via a resistor 35. Further, one end of a capacitor 36 is connected to the resistor 35 and the terminal R, and the other end of the capacitor 36 is connected to a terminal C and to ground. The duration of the period T1 is specified by a time constant which is set by use of the resistor 35 and the capacitor 36.

A terminal A (input terminal) of the monostable multivibrator 34 is connected to a node between the resistor 37 and the capacitor 38. The illumination/extinction discrimination signal Si is supplied to one end of the resistor 37, and the other end of the resistor 37 is grounded via the capacitor 38. If it is determined that the discharge lamp is extinguished, the illumination/extinction discrimination signal Si indicates the H level, and if it is determined that the discharge lamp is illuminating, the illumination/extinction discrimination signal Si indicates the L level.

At a time of initialization, a POR signal from a power-on-reset (denoted as "POR") circuit 39 is supplied to a terminal CD (active low input) of the monostable multivibrator 34. In the example configuration 33, the POR circuit 39 is configured as a CR circuit which is constituted of a resistor 40 and a capacitor 41; and two Schmitt-trigger-type NOT gates 42 and 43. The power supply voltage Vcc is supplied to one end of the resistor 40, and the other end of the resistor 40 is grounded via the capacitor 41. An input terminal of the NOT gate 42 at the antecedent stage is connected to a point between the resistor 40 and the capacitor 41. An output signal from the NOT gate 42 is supplied to the terminal CD via the NOT gate 43 at the subsequent stage. Meanwhile, an output signal from the NOT gate 42 is supplied to a base of a grounded-emitter NPN transistor 45 via a resistor 44. Further, a collector of the transistor 45 is connected to one end of the capacitor 38 (i.e., the transistor 45 is temporarily activated at a time of initialization).

The pulse signal S1 is output from a terminal Q of the monostable multivibrator 34. The pulse signal S1 has a pulse width which is identical with the time period T1 from a moment when the discrimination signal S1 has reached an H level. Further, the pulse signal S1_B is output from a terminal Q bar (in FIG. 11, the terminal Q bar is indicated by placing a bar on Q), and is also supplied to a terminal B (active low input)

The pulse signal S1 is supplied to one of input terminals of a two-input OR gate 46, and is also supplied to the other input terminal of the OR gate 46 via a delay section (delay elements, or the like) 47. An output signal from the OR gate 46 is supplied to a base of an NPN transistor 49 via a resistor 48. The transistor 49 is emitter-grounded, and a collector of the transistor 49 is connected to one end of the capacitor 38. The above circuit section can help prevent harmful effects caused by the erroneous discrimination of illumination/extinction. That is, within the frequency region fa2 (see FIG. 2), at the time a frequency is caused to transition to the frequency region fb after the discharge lamp is illuminated, voltage detection or current detection of the discharge lamp results in an unstable state instantaneously. This state may cause erroneous discrimination of illumination/extinction. For example, if it is determined that the discharge lamp is extinguished despite actually being illuminating, the frequency maybe transitioned to the frequency region fa2. Accordingly, to avoid such a problem, the transistor 49 may be activated so as to mask the illumination/extinction discrimination signal Si (i.e., forcibly brought into the L level) for several milliseconds after a transition to the frequency region fb.

In the example configuration 33, the CR time constant is used for setting the period T1. However, the configuration is not limited thereto, and there maybe employed a configuration where an internal basic clock is counted by a counter.

Figure 12:
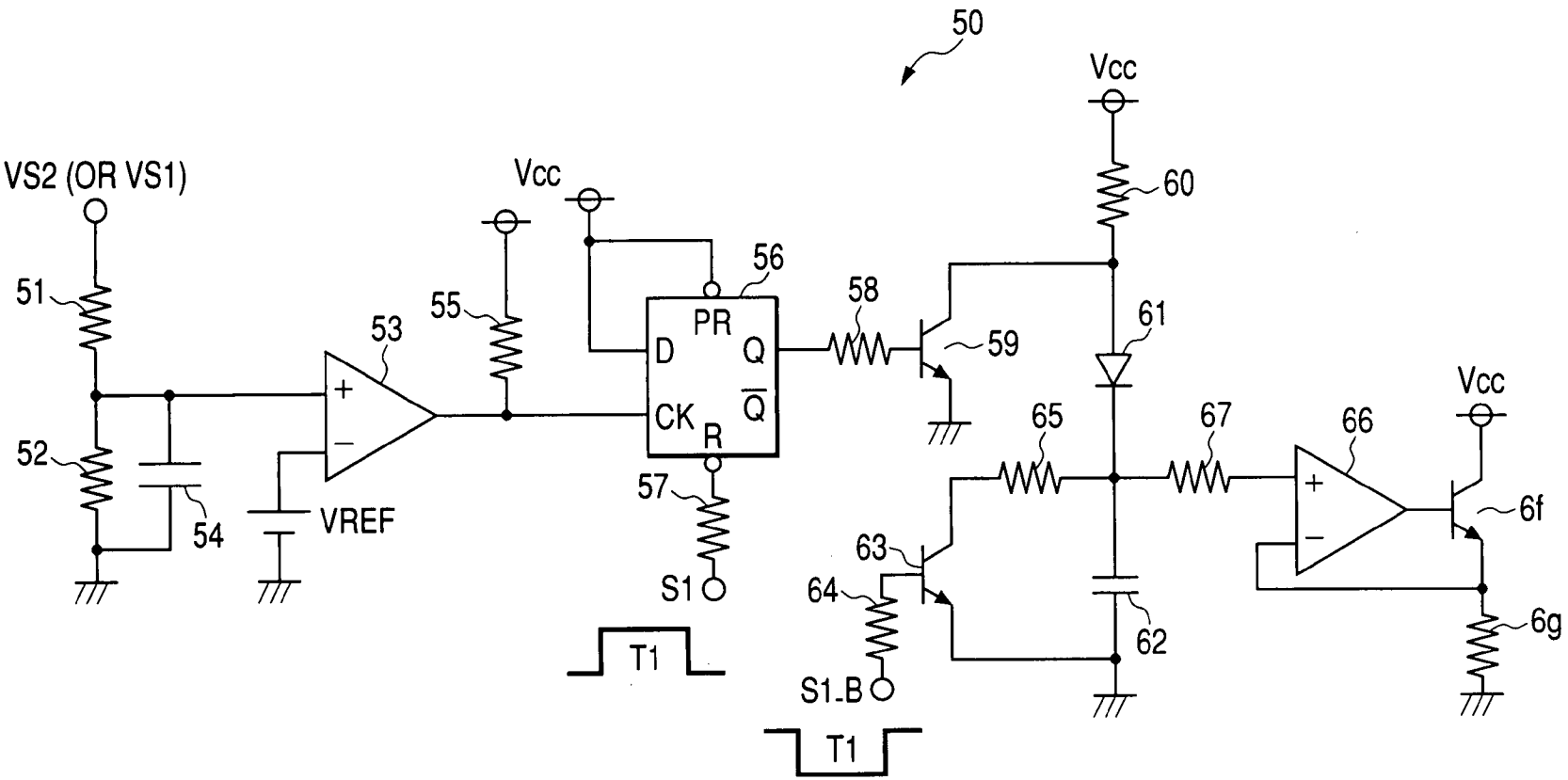

FIG. 12 is a circuit diagram showing an example configuration 50 of the OCV control circuit 6*d*.

The detection voltage VS2 (or VS1) is divided by resistors 51 and 52, and supplied to a non-inverting input terminal of a comparator 53. A predetermined reference voltage (denoted as "VREF") is supplied to an inverting input terminal of the comparator 53, whereby a detection value of VS2 (or VS1) is compared with VREF. A capacitor 54 is connected in parallel with the resistor 52. A pull-up resistor 55 is connected to an output terminal of the comparator 53.

The predetermined power supply voltage Vcc is supplied to a terminal D of a D flip-flop 56, and a preset (PR) terminal of active low input of the D flip-flop 56. An output signal from the comparator 53 is supplied to a clock-signal-input terminal (CK). Further, the pulse signal S1 is supplied to a reset (R) terminal as an active low input via a resistor 57.

An output signal Q from the D flip-flop 56 is supplied to a base of a grounded-emitter NPN transistor 59 via a resistor 58. A collector of the transistor 59 is connected to a circuit power supply terminal (power supply voltage Vcc) via a resistor 60.

An anode of a diode 61 is connected to one end of the resistor 60, and a cathode of the diode 61 is connected to one end of a capacitor 62. The other end of the capacitor 62 is grounded.

The signal S1_B is supplied to a base of a grounded-emitter NPN transistor 63 via a resistor 64. A collector of the transistor 63 is connected to a node between the diode 61 and the capacitor 62 via a resistor 65.

An operational amplifier 66 and an NPN transistor 6*f*—which is provided at an output stage of the operational amplifier 66—form a buffer. A non-inverting input terminal of the operational amplifier 66 is connected to a node between the diode 61 and the capacitor 62 via a resistor 67. Further, an output terminal of the operational amplifier 66 is connected to a base of the transistor 6*f*. An emitter of the transistor 6*f* is connected to the inverting input terminal of the operational amplifier 66, and is also grounded via a resistor 6*g*. A power supply voltage Vcc is supplied to the collector of the transistor 6*f*.

In the circuit, when power is turned on or when the discharge lamp is illuminating, the pulse signal S1 falls to the L level, and the D flip-flop 56 is reset. As a result, the output signal Q falls to an L level, and the transistor 59 is deactivated. In addition, because the pulse signal S1_B is at an H level, the transistor 63 is activated, and a terminal potential of the capacitor 62 falls to an L level. Therefore, an output (i.e., an emitter potential of the transistor 6*f*) of the circuit falls to an L level.

When the discharge lamp is extinguished, the pulse signal S1 reaches an H level, and the D flip-flop 56 is released from the reset condition. Further, the signal S1_B falls to an L level and the transistor 63 is deactivated. Hence, discharging from the capacitor 62 is stopped, and charging of the capacitor 62 is started via the resistor 60 and the diode 61. An emitter potential of the transistor 6*f* is increased as the capacitor is charged. Accordingly, the frequency is gradually decreased. More specifically, the frequency is gradually decreased within the frequency region fa2 (see FIG. 2), and the OCV value is gradually increased. When the OCV attains a target value (see P3 in FIG. 2), an output from the comparator 53 reaches an H level. That is, when a detection voltage which is divided by the resistors 51 and 52 reaches VREF or higher, the D flip-flop 56 is set by the output signal from the comparator 53, and the output signal Q is transited to an H level. Hence, the transistor 59 is activated, and charging of the capacitor 62 is stopped. Therefore, a terminal potential of the capacitor 62 and the emitter potential of the transistor 6*f* are fixed. As a result, the frequency value is maintained constant. When the transition-to-steady-illumination period T1 has elapsed, the signal S1 falls to an L level, the D flip-flop 56 is reset, the output signal Q is transited to the L level, and the transistor 59 is deactivated. When the signal S1_B reaches the H level and the transistor 63 is activated, the capacitor 62 is discharged, whereby the terminal potential falls to an L level. Accordingly, the emitter potential of the transistor 6*f* falls to an L level, and the frequency, which has finished the frequency-fixed period, is transitioned to the frequency region fb.

Figure 13:
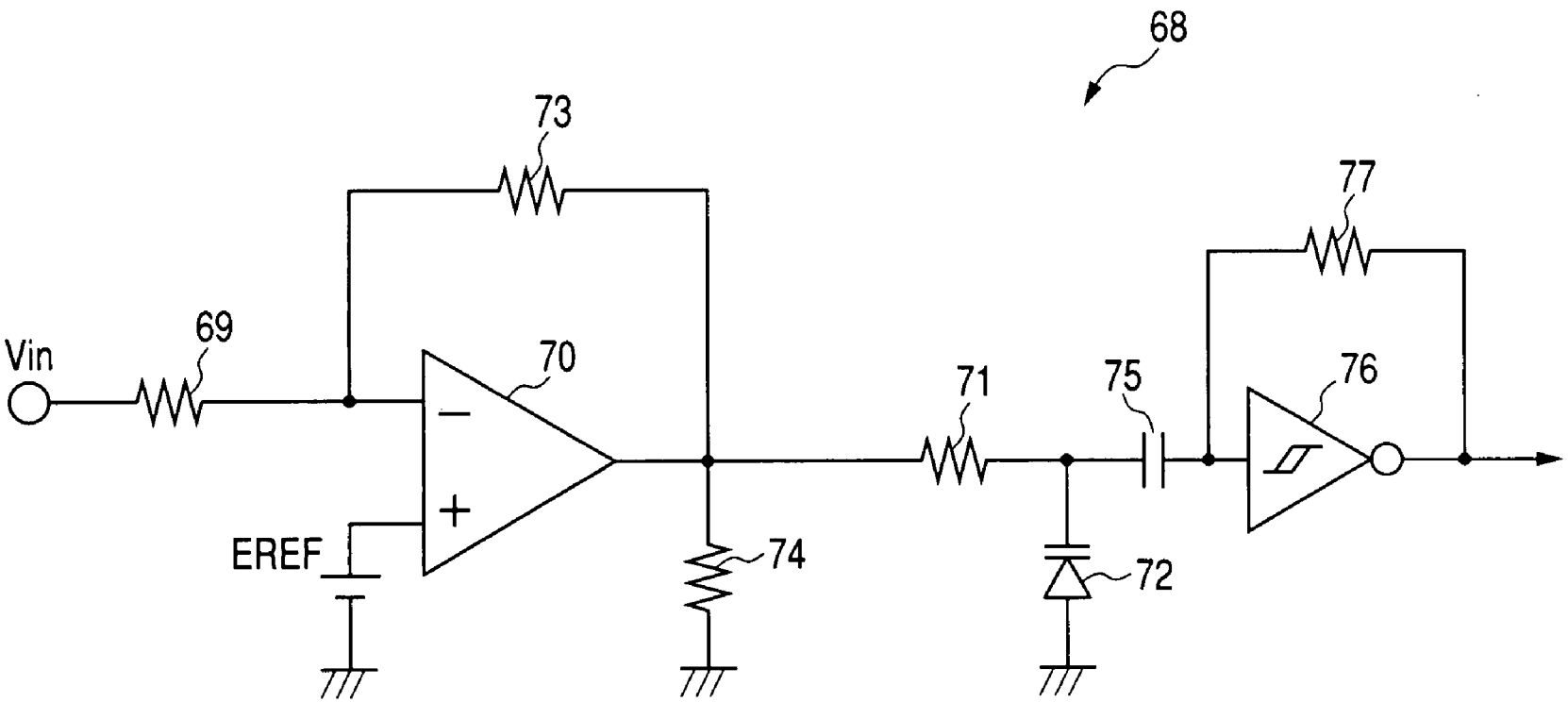

FIG. 13 shows a main portion 68 of an example configuration of the V-F conversion circuit 6*a*.

The input voltage Vin is supplied to an inverting input terminal of an operational amplifier 70 via a resistor 69. A predetermined reference voltage EREF is supplied to a non-inverting input terminal of the operational amplifier 70. An output signal from the operational amplifier 70 is supplied to a voltage-variable capacitance diode 72 via a resistor 71. Further, a resistor 73 is provided between the inverting input terminal and an output terminal of the operational amplifier 70. One end of a resistor 74 is connected to the output terminal of the operational amplifier 70, and the other end of the resistor 74 is grounded.

A cathode of the voltage-variable capacitance diode 72 is connected to a portion between the resistor 71 and a capacitor 75, and an anode of the voltage-variable capacitance diode 72 is grounded. Further, an input terminal of a Schmitt-trigger-type NOT gate 76 is connected to the cathode of the voltage-variable capacitance diode 72. A resistor 77 is connected in parallel with the NOT gate 76. A frequency-variable oscillating circuit is formed from the above elements, whereby an output pulse from the NOT gate 76 is supplied to the circuit section 6*b* at the subsequent stage. Specifically, the bridge-drive-signal generation circuit 6*b* generates drive signals for controlling the respective switching elements on the basis of pulse signals, and supplies the drive signals to the bridge drive circuit 6*c*. Alternative configurations may be used for the circuits 6*b* and 6*c*.

In the example configuration 68, when a level of Vin is increased (decreased), an output potential from the operational amplifier 70 is decreased (increased), thereby increasing (decreasing) a capacitance of the voltage-variable capacitance diode 72. As a result, a frequency of the output pulse is decreased (increased).

Figure 14:
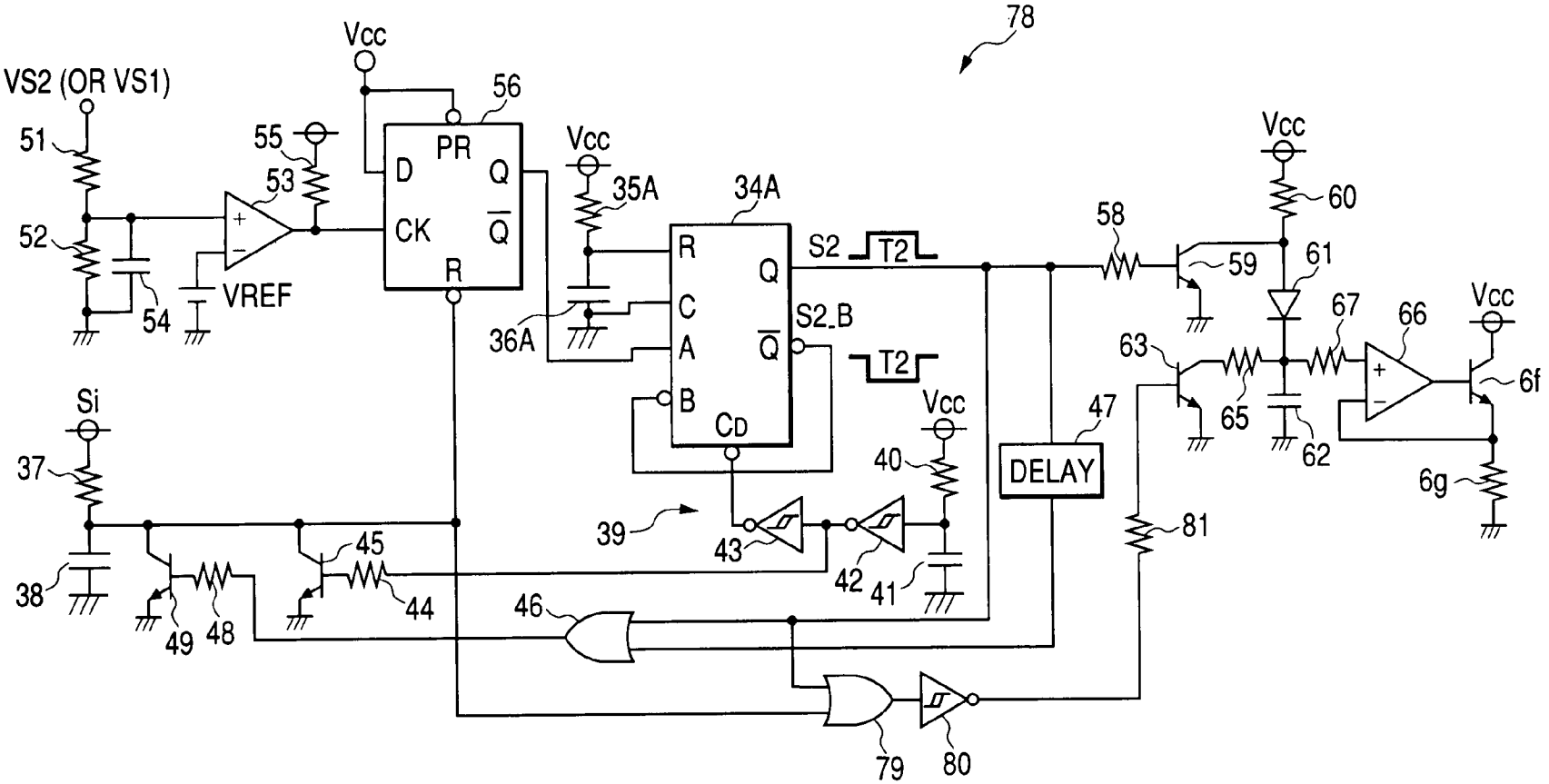

Next, the configuration pattern 2 will be described by reference to FIG. 14. FIG. 14 shows an example configuration 78 of a T2 signal generation circuit associated with the OCV control circuit and the frequency-fixed period. An output voltage from the T2 signal generation circuit is supplied to the V-F conversion circuit 6*a*. In the example configuration 78, portions which are functionally identical with those of FIG. 11 or 12 are denoted by the same reference numerals.

The detection voltage VS2 (or VS1) is divided by the resistors 51 and 52, and thereby supplied to a non-inverting input terminal of the comparator 53. The predetermined reference voltage VREF is supplied to an inverting input terminal of the comparator 53, and the detection value of VS2 (or VS1) is compared with VREF. The capacitor 54 is connected in parallel with the resistor 52. The pull-up resistor 55 is connected to an output terminal of the comparator 53.

The predetermined power supply voltage Vcc is supplied to the terminal D and the terminal PR of the D flip-flop 56. An output signal from the comparator 53 is supplied to the clock-signal-input terminal CK. Further, the discrimination signal Si associated with illumination/extinction is supplied to the terminal R as an active low input via the resistor 37 and the capacitor 38.

The output signal Q from the D flip-flop 56 is supplied to a terminal A of a monostable multivibrator 34A at a subsequent stage.

In the example configuration 78, the monostable multivibrator 34A generates a signal S2—which is a pulse signal having the same width as the predetermined period T2—and a signal S2_B—which is an inverted signal of S2.

The predetermined power supply voltage Vcc is supplied to a terminal R of the monostable multivibrator 34A via a resistor 35A. Further, one end of a capacitor 36A is connected to the resistor 35A and the terminal R. The other end of the capacitor 36A is connected to a terminal C and is also grounded. The duration of the period T2 is specified by a time constant which is set by use of the resistor 35A and the capacitor 36A.

At the time of initialization, a POR signal from the POR circuit 39 is supplied to a terminal CD (active low input) of the monostable multivibrator 34A. The POR circuit 39 includes the resistor 40, the capacitor 41, and the two Schmitt-trigger-type NOT gates 42 and 43. An input terminal of the NOT gate 42 is connected to a point between the resistor 40 and the capacitor 41. An output signal from the NOT gate 42 is supplied to the terminal CD via the NOT gate 43. The output signal from the NOT gate 42 is supplied to the base of the grounded-emitter NPN transistor 45 via the resistor 44. Further, the collector of the transistor 45 is connected to one end of the capacitor 38.

The pulse signal S2 is output from a terminal Q of the monostable multivibrator 34A. The pulse signal S2 is caused to have a pulse width which is identical to the time period T2 from a moment when the OCV has attained the target value. Further, the pulse signal S2_B is output from a terminal Q bar (in FIG. 14, the terminal Q bar is indicated by placing a bar on Q), and is also supplied to a terminal B (active low input)

The pulse signal S2 is supplied to the base of the grounded-emitter NPN transistor 59 via the resistor 58. The collector of the transistor 59 is connected to a circuit power supply terminal (power supply voltage Vcc) via the resistor 60. Further, the pulse signal S2 is supplied to one of the input terminals of the OR gate 46, and is also supplied to other input terminal of the OR gate 46 via the delay section 47. The output signal from the OR gate 46 is supplied to the base of the grounded-emitter NPN transistor 49 via the resistor 48. The collector of the grounded-emitter NPN transistor 49 is connected to one end of the capacitor 38. Meanwhile, as mentioned hither to, the above circuit section can help prevent harmful effects caused by the erroneous discrimination of illumination/extinction.

The diode 61 is connected to the resistor 60. The cathode of the diode 61 is connected to one end of the capacitor 62, and the other end of the capacitor 62 is grounded.

The collector of the grounded-emitter NPN transistor 63 is connected to a node between the diode 61 and the capacitor 62 via the resistor 65. Further, an output signal from a two-input OR gate 79 is supplied to a base of the transistor 63 via a Schmitt-trigger-type NOT gate 80 and a resistor 81. Meanwhile, the pulse signal S2 is supplied to one of input terminals of the OR gate 79, and the illumination/extinction discrimination signal Si is supplied to the other input terminal via the CR circuit (i.e., the resistor 37 and the capacitor 38).

The operational amplifier 66 and the NPN transistor 6*f*—which is provided at the output stage of the operational amplifier 66—form a buffer. The non-inverting input terminal of the operational amplifier 66 is connected to a node between the diode 61 and the capacitor 62 via the resistor 67. Further, the output terminal of the operational amplifier 66 is connected to the base of the transistor 6*f*. The emitter of the transistor 6*f* is connected to the inverting input terminal of the operational amplifier 66, and is also grounded via the resistor 6*g*. An emitter output from the transistor 6*f* is sent to the V-F conversion circuit 6*a* at the subsequent stage as Vin.

In the circuit, when power is on or when the discharge lamp is illuminating, the illumination/extinction discrimination signal Si is in the L level, and the D flip-flop 56 is reset.

As a result, the output signal Q from the D flip-flop is brought to an L level, and the output signal Q from the monostable multivibrator 34A is also brought to an L level, whereupon the transistor 59 is deactivated. In addition, an L level signal output from the OR gate 79 is converted to an H level signal through the Schmitt-trigger-type NOT gate 80. Accordingly, the transistor 63 is activated, and a terminal potential of the capacitor 62 falls to the L level. Therefore, an output (i.e., an emitter potential of the transistor 6*f*) from the circuit falls to the L level.

When the discharge lamp is extinguished, the illumination/extinction discrimination signal Si reaches the H level, and the D flip-flop 56 is released from the reset condition. Simultaneously, the output signal from the OR gate 79 reaches the H level, then falls to the L level after passing through the NOT gate 80. Accordingly, the transistor 63 is deactivated. Charging of the capacitor 62 is started to increase the voltage of the capacitor 62. When the OCV value attains a target value, an H level signal output from the comparator 53 is input to the D flip-flop 56. The output signal Q from the D flip-flop 56 reaches the H level (i.e., is latched) and is supplied to the monostable multivibrator 34A. As a result, the pulse signal S2 having a pulse width identical with the predetermined time period T2 is output from the terminal Q, and the transistor 59 is activated. Hence, charging of the capacitor 62 is inhibited. The transistor 63 is retained in a deactivated state. Accordingly, a terminal potential of the capacitor 62 and an emitter potential of the transistor 6*f* are fixed. As a result, the frequency value is maintained constant. During the above operation, latching by the D flip-flop 58 is disabled After the predetermined time period T2 has elapsed, the pulse signal S2 falls to an L level. Further, after elapse of a time period set by the delay section 47, the D flip-flop 56 is reset. The frequency, which has finished the frequency-fixed period, is to be transitioned to the frequency region fb. However, when the discharge lamp is extinguished after temporary illumination, the latching is enabled and the control is caused to reenter transition-to-illumination control.

Other implementations are within the scope of the following claims.

What is claimed is:

1. A discharge lamp illumination circuit comprising:

a DC-AC conversion circuit which effects AC conversion and boosting upon receipt of a DC input; and a starter circuit for supplying a start-up signal to a discharge lamp, the discharge lamp illumination circuit being used for illumination control using control means for controlling a power output from the DC-AC conversion circuit, wherein the DC-AC conversion circuit comprises an AC transformer; a plurality of switching elements; and a resonance capacitor, wherein the switching elements are activated by the control means, to induce series resonance between the resonance capacitor and an inductance component of the AC transformer, or between the resonance capacitor and an inductance element connected to the resonance capacitor; and in relation to the operating frequency of the switching elements, a first frequency value and a second frequency are substantially the same, wherein the first frequency value corresponds to a period before the discharge lamp is illuminated, and the second frequency value corresponds to a period from illumination of the discharge lamp by the starter circuit until elapse of a predetermined time period or a time period specified in accordance with an illumination state.

2. The discharge lamp illumination circuit according to claim 1 wherein the first and second frequency values are specified as values higher than a series resonance frequency of a period before the discharge lamp is illuminated.

3. The discharge lamp illumination circuit according to claim 1 wherein a voltage applied on the discharge lamp from the DC-AC conversion circuit before the discharge lamp is illuminated is higher than a voltage applied on the discharge lamp from the DC-AC conversion circuit after the discharge lamp has been illuminated.

4. The discharge lamp illumination circuit according to claim 1 wherein when an upper limit frequency value as determined from an intersection of a resonance curve pertaining to an output voltage applied on the discharge lamp during an extinction period before illumination of the discharge lamp and a maximum voltage of an extinction period of a discharge lamp is denoted as "famax," and a lower limit frequency value as determined from an intersection of a resonance curve pertaining to the output voltage applied on the discharge lamp during an illumination period of the discharge lamp and a minimum voltage with which illumination of the discharge lamp can be maintained is denoted as "famin,"

an electrostatic capacitance of the resonance capacitor, and an inductance of the AC transformer or that of the inductance element are set so that the first and second frequency values fall within the range of famin to famax.

* * * * *